US007607567B2

(12) United States Patent
Fry et al.

(10) Patent No.: US 7,607,567 B2
(45) Date of Patent: Oct. 27, 2009

(54) ONE-PIECE SHIPPING CONTAINER WITH DIFFERENTLY CONTOURED INNER AND OUTER WALLS AND A QUICK-LOCK BOTTOM

(75) Inventors: Stanley L. Fry, West Covina, CA (US); Timi D. DiSalvo, Huntington Beach, CA (US)

(73) Assignee: International Paper Co., Memphis, TN (US)

( * ) Notice: Subject to any disclaimer, the term of this patent is extended or adjusted under 35 U.S.C. 154(b) by 472 days.

(21) Appl. No.: 10/851,676

(22) Filed: May 21, 2004

(65) Prior Publication Data

US 2005/0109826 A1 May 26, 2005

Related U.S. Application Data

(60) Provisional application No. 60/473,206, filed on May 23, 2003.

(51) Int. Cl.
*B65D 5/02* (2006.01)

(52) U.S. Cl. ..... 229/178; 229/185.1; 229/918; 229/919

(58) Field of Classification Search ..... 229/178, 229/165, 174, 157, 177, 918, 915, 185.1, 229/117.16, 117.17, 167; 206/512, 485
See application file for complete search history.

(56) References Cited

U.S. PATENT DOCUMENTS 1,001,781 A 8/1911 Steffen
1,085,188 A 1/1914 Arnold
1,580,147 A 4/1926 McClean
2,295,141 A 9/1942 van Wingen
2,735,607 A * 2/1956 Wasyluka ..... 229/117.17
3,178,096 A 4/1965 Reeves et al.

(Continued)

FOREIGN PATENT DOCUMENTS

GB 2264484 * 9/1993

(Continued)

*Primary Examiner*—Nathan J Newhouse
*Assistant Examiner*—Christopher Demeree
(74) *Attorney, Agent, or Firm*—Dennis Lambert; Matt Eslami

(57) ABSTRACT

A container (10) for shipping products has opposed end walls (11, 12) and opposed side walls (13, 14), each having an inner wall panel (16, 17 and 20, 21, respectively) and an outer wall panel (18, 19 and 22, 23, respectively) defining double thickness walls. The outer wall panels in the side walls are disposed orthogonally to the outer wall panels in the end walls to define a rectangular or square outer container configuration, and extension panels (25*a*, 25*b*) on opposite side edges of a first pair (16, 17) of the inner wall panels extend diagonally across interior corners of the container to define with the inner wall panels an octagonal inner container configuration. Bottom flaps (40, 41, 42 and 43) foldably connected to the bottom edges of the outer wall panels form a peripheral bottom wall (15), and include quick-lock detents (46, 47 and 52, 53, 54) to enable quick and easy set up of the bottom. In one embodiment (10'), a reinforcing panel (61) is formed in two of the inner wall panels, and is foldable to a position between the inner and outer wall panels, at the top thereof, to reinforce the walls of the container. A blank (B, B') for making the container (10, 10') is also disclosed.

20 Claims, 13 Drawing Sheets

U.S. PATENT DOCUMENTS

| | | | | |
|---|---|---|---|---|
| 3,727,824 | A | 4/1973 | Giebel et al. | |
| 3,884,350 | A * | 5/1975 | Johansson | 229/122 |
| 4,151,948 | A | 5/1979 | de la Fuente, Jr. | |
| 4,441,649 | A * | 4/1984 | Nederveld | |
| 5,139,196 | A * | 8/1992 | Fry et al. | 229/157 |
| 5,294,044 | A | 3/1994 | Clark | |
| 5,305,950 | A * | 4/1994 | Oppenheim | |
| 5,328,088 | A | 7/1994 | Lonczak | |
| 5,752,648 | A | 5/1998 | Quaintance | |
| 6,076,730 | A | 6/2000 | Boutin et al. | |
| 6,220,508 | B1 | 4/2001 | Wisser | |
| 6,227,442 | B1 * | 5/2001 | Evans, Jr. | |
| 6,293,460 | B1 | 9/2001 | Boutin et al. | |
| 6,364,200 | B1 | 4/2002 | Moss et al. | |
| 6,386,437 | B1 | 5/2002 | Larson, Jr. | |
| 6,481,619 | B1 | 11/2002 | Jackson | |
| 6,604,675 | B2 * | 8/2003 | Southwell | 229/164 |
| 6,712,214 | B1 * | 3/2004 | Wintermute et al. | 206/745 |
| 6,719,191 | B1 * | 4/2004 | Christensen et al. | 229/122.26 |
| 2004/0211825 | A1 * | 10/2004 | Champion et al. | 229/178 |
| 2005/0109826 | A1 * | 5/2005 | Fry et al. | |

FOREIGN PATENT DOCUMENTS

| | | | |
|---|---|---|---|
| GB | 2264484 | A * | 9/1993 |

* cited by examiner

B

ONE-PIECE SHIPPING CONTAINER WITH DIFFERENTLY CONTOURED INNER AND OUTER WALLS AND A QUICK-LOCK BOTTOM

This application claims the benefit of U.S. provisional patent application Ser. No. 60/473,206, filed May 23, 2003.

TECHNICAL FIELD

This invention relates to containers, and more particularly to a one-piece shipping container made of paperboard and having an inner wall contoured differently than the outer wall, and a quick-lock bottom.

BACKGROUND ART

Bulk containers made of various materials and in a variety of shapes are used for shipping, storing and displaying many products, including fresh produce such as watermelon. Bulk containers made of corrugated paperboard, in particular, are popular because of their relatively low cost, light weight and recyclability. Among these, bulk containers having an octagonal cross-section are in widespread use because of their strength and other desirable attributes. For example, an octagonal container has greater stacking strength and experiences less outward bulge of the sidewalls than a comparably sized rectangular or square container. On the other hand, square or rectangular containers better fit on and fill out the available space on the square or rectangular pallets commonly used with these containers. Square or rectangular containers also offer greater graphics capabilities than octagonal containers.

Further, to reduce the cost of storage and shipment, many prior art containers are shipped to the point of use in a knocked-down or flattened condition, and then erected or set up into a ready-to-use condition at the point of use. Conventional constructions can be difficult to manipulate from a flattened condition to a set-up condition, resulting in increased labor costs and dissatisfaction.

Examples of prior art octagonal containers are described in commonly owned U.S. Pat. Nos. 5,139,196 and 6,386,437. These containers have an octagonal shape at both their inner and outer surfaces, and are shipped to the user in a flattened condition. They both incorporate a bottom locking structure intended to facilitate moving the containers from a flattened condition to a set-up condition.

Examples of prior art containers having a square or rectangular outer shape are described in U.S. Pat. Nos. 2,295,141, 4,151,948, 5,294,044 and 6,481,619. All of these except the '619 patent also have interior diagonal corner panels to increase the stacking strength of the container.

The diagonal corner panels in the '141 patent are formed by extension flaps 7 on the side edges of end roll-over panels 6. The roll-over panels also capture end flaps 4 on adjacent sidewall panels, and have locking tabs 9 on their bottom edges, which engage in openings 10 at the juncture of the end walls with the bottom wall to hold the roll-over panels and the sidewalls in place. Extensions 8 on the outer edges of the flaps 7 are reversely folded to lie along an inner surface of the adjacent sidewall and abut against the adjacent end wall.

The diagonal corner panels 32 in the '948 patent also are formed on opposite side edges of end roll-over panels 30, which have a locking tab 22 on their bottom edges that engage in openings 23 to hold the roll-over panels in place. The roll-over panels also capture double-folded flaps 24 and 26 on the ends of sidewall panels to hold them in place.

In the '044 patent, gusset or pleat folds 64 at the junctures of adjacent side and end wall panels are folded together and glued to form a vertical reinforcement in the corners. The diagonal corner panels are formed by extension flaps 68 on opposite sides of opposed end roll-over panels 48 and 50. Glue flaps 70 on the outer edges of the flaps 68 are glued to the adjacent side walls 24 and 28 to hold the diagonal corner panels in place.

None of the foregoing patents discloses or suggests a bulk container that is shipped in a flattened condition and is set up at the point of use to form a container having a square or rectangular outer configuration and an octagonal inner configuration, wherein all four side walls, i.e., the side walls and the end walls, comprise inner and outer wall panels to form a double thickness wall. Further, none of the foregoing patents discloses such a double-walled container wherein the container is held in set-up condition solely by interlocking engagement of the parts, and further wherein the container has a quick-lock bottom structure.

Accordingly, there is need for an easy to erect bulk container that has the strength of an octagonal container and the pallet-fitting shape and graphics capability of a square or rectangular container.

DISCLOSURE OF THE INVENTION

The present invention comprises an easy to erect bulk container that has the strength of an octagonal container and the pallet-fitting shape and graphics capability of a square or rectangular container.

The container of the invention has outer wall panels forming a square or rectangle in plan view, and inner wall panels and diagonal corner panels that form an octagon in plan view. The container thus has an outer shape that is best adapted to fit on a pallet, and an inner shape that provides the strength advantages of an octagonal container. Moreover, the square or rectangular outer shape provides increased graphics capabilities in comparison with a comparably sized octagonal container. As used herein, the terms "wall" or "wall panels" refers generically to the upright walls defining the perimeter of the container, and specifically includes two opposed parallel side walls or wall panels and two opposed parallel end walls or wall panels perpendicular to the side walls.

Each side wall and each end wall of the container comprises both an outer wall panel and an inner wall panel, forming a double wall construction that provides greater strength and resists outward bulging of the walls due to the weight and pressure of material in the container. Further, in one embodiment of the invention two walls of the container include a reinforcing panel that can be folded into a position at the top of the walls to form a triple thickness structure in that area, providing even greater strength and resistance to outward bulging of the walls, particularly at the tops thereof.

The container also includes a quick-lock bottom structure comprising a bottom-forming panel foldably joined to a bottom edge of each outer wall panel. Cooperating detent means on opposite side edges of the bottom-forming panels is automatically engaged when a first pair of oppositely disposed panels are first folded inwardly over the bottom, and the second pair is then folded over the first pair and pressed downwardly.

The container is made from a single unitary blank of corrugated paperboard and is assembled in a flattened condition by the manufacturer for shipment to a point of use, where the container can be quickly and easily set up into a fully erected condition ready for use. The blank has an elongate rectangular shape and comprises first, second, third and fourth outer wall-forming panels foldably joined together along adjacent end edges, and forming first and second pairs of opposed outer wall panels in an erected container. First, second, third and fourth inner wall-forming panels are each foldably joined to a first side edge of a respective one of the four outer wall-forming panels. The inner wall-forming panels are separate from one another and in an erected container form first and second pairs of opposed inner wall-forming panels associated, respectively, with the first and second pairs of outer wall-forming panels.

AD extension panel is foldably joined to each of the opposite side edges of the inner wall-forming panels of said first pair, and form diagonal corner panels extending across the interior corners of an erected container. An assembly panel is foldably joined to the outer side edge of each extension panel, and in a container erected from the blank these assembly panels are captured between adjacent inner and outer wail panels of the second pair.

A bottom-forming flap is foldably joined to each outer wall-forming panel along a second side edge opposite the first edge. The bottom forming flaps are relatively narrow and do not close the bottom of a container erected from the blank, but form a peripheral annular bottom wall around the interior bottom of an erected container, with opposed bottom-forming flaps spaced from one another, and with adjacent side edges of adjacent flaps overlapping one another. The flaps of a first pair of the bottom-forming flaps are disposed in spaced, parallel, opposed relationship to one another in an erected container, and the outer corners of the flaps of the first pair are cut away, forming notches in the outer corners, whereby the notches in one flap are in spaced, confronting relationship to the notches in an opposed flap. The flaps of a second pair of bottom-forming flaps extend perpendicular to and between the flaps of the first pair in an erected container, and have inwardly angled side edges terminating in a locking tongue on the outer free edges thereof. In an erected container, the locking tongue is engaged at its opposite side edges in the confronting notches in the side edges of opposed flaps of the first pair, with the tongue lying against an interior surface of the flaps of the first pair, and the angled side edges lying against an exterior surface.

First openings or slots are formed in the fold joining the bottom-forming flaps of the first pair to said second side edge of respective outer wall-forming panels, and locking tabs are formed on the outer free edges of the inner wall-forming panels on the opposite, first side edge of said respective outer wall forming panels. In an erected container the locking tabs engage in the slots to retain the inner and outer wall panels in operative position. Second openings or slots are formed in the fold joining said inner wall-forming panels of said second pair to said respective outer wall-forming panels, and locking tabs are formed on opposite ends of said assembly panels for engagement in said second openings and in at least some of said first openings, whereby the assembly panels are locked at both ends in an erected container.

In an alternate embodiment, a cut is made in each of said inner wall-forming panels of said second pair, forming a reinforcing panel that is foldably connected along one edge to the respective inner wall-forming panel. In a container erected from the blank, the reinforcement panel is folded up and between the associated inner and outer panels, extending at its free edge to the fold joining the inner and outer wall-forming panels, providing reinforcement at the upper edge of the wall of the container to further strengthen the container against sidewall bulge. Locking tabs on the outer ends of the free edge of the reinforcement panel engage in said second openings to help hold the container in erected condition.

The container of the invention is exceptionally easy to set up into an operative condition, and to this end the quick-lock bottom can be quickly and easily folded into operative interlocked relationship simply by folding the bottom-forming flaps inwardly over the open bottom and pressing them downwardly (with the container inverted into an upside-down position), whereupon cooperating detent means on the flaps move past one another into a locked position. After the bottom is set up, the container is moved into an upright position, and the first pair of opposed inner wall panels are folded downwardly into the container to lie against an inner surface of the respective associated outer wall panels. The extension panels on opposite side edges of the first pair of inner wall panels engage adjacent walls and arc deflected or partially folded so that they extend diagonally across the interior corners of the container. The assembly panels on the outer edges of the extension panels lie against the inner surface of the adjacent walls when the first pair of inner wall panels are in their fully folded operative position, and at least one of the locking tabs on each assembly panel engages in an opening to hold the first pair of inner panels in folded position. The second pair of opposed inner wall panels, located orthogonally to the first pair, is then folded downwardly into the container to lie against an inner surface of the associated outer wall panel, whereupon the locking tabs on a lower end of the inner wall panels engage in slots to hold the second pair of inner wall panels in operative folded position, with the assembly panels captured between the inner and outer wall panels of the second pairs.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DESCRIPTION OF THE PREFERRED EMBODIMENTS

Figure 1:
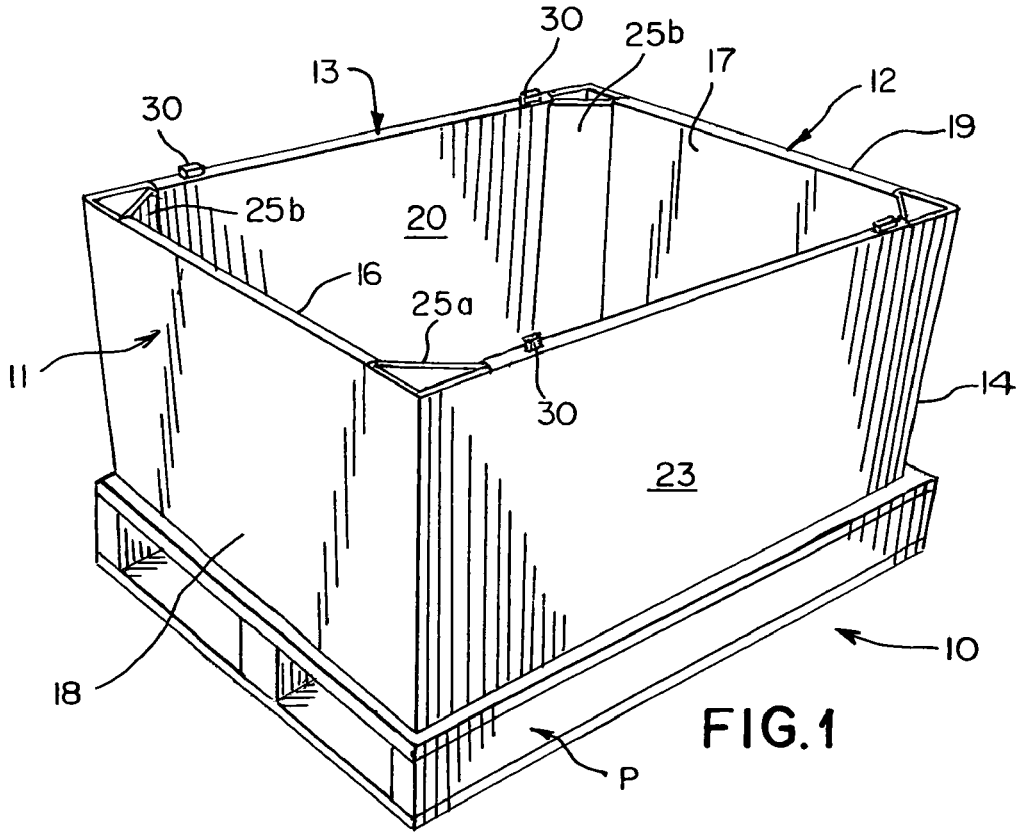
FIG. 1 is a top perspective view of a first form of container according to the invention, shown mounted on a pallet.
Figure 2:
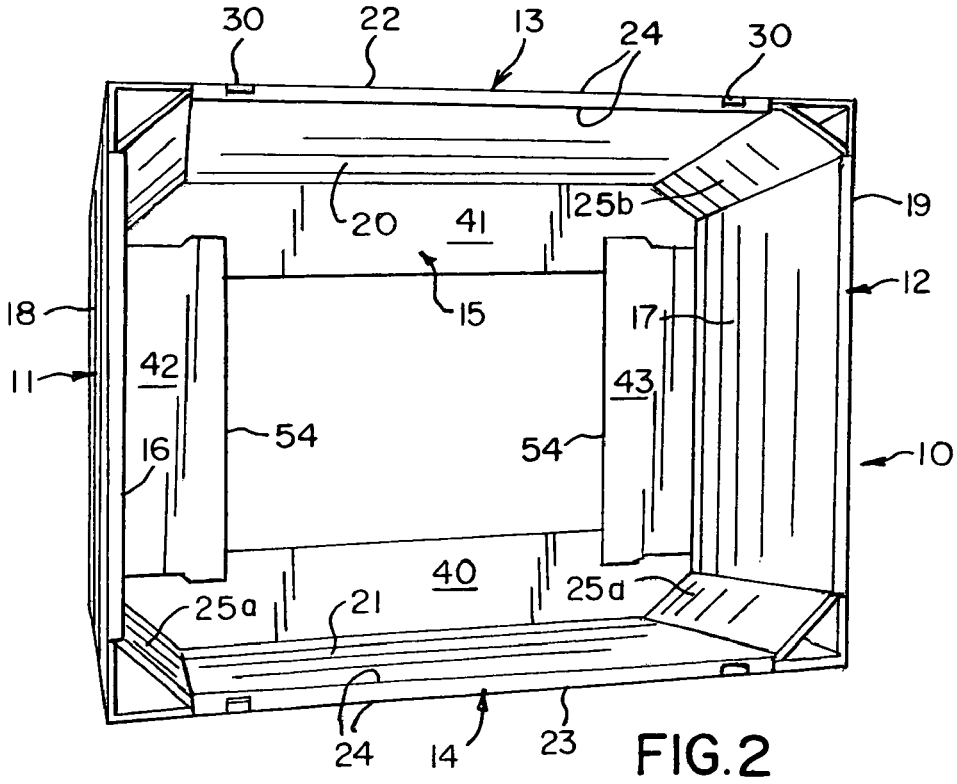
FIG. 2 is a top plan view of the container of FIG. 1.

A first embodiment of a container according to the invention is indicated generally at 10 in FIGS. 1, 2 and 4-14. As shown in FIG. 1, the container is assembled to a pallet P. The pallet shown is for example only, and other pallet designs, e.g., for four-way access by the tines of a forklift, could be employed.

Figure 3:
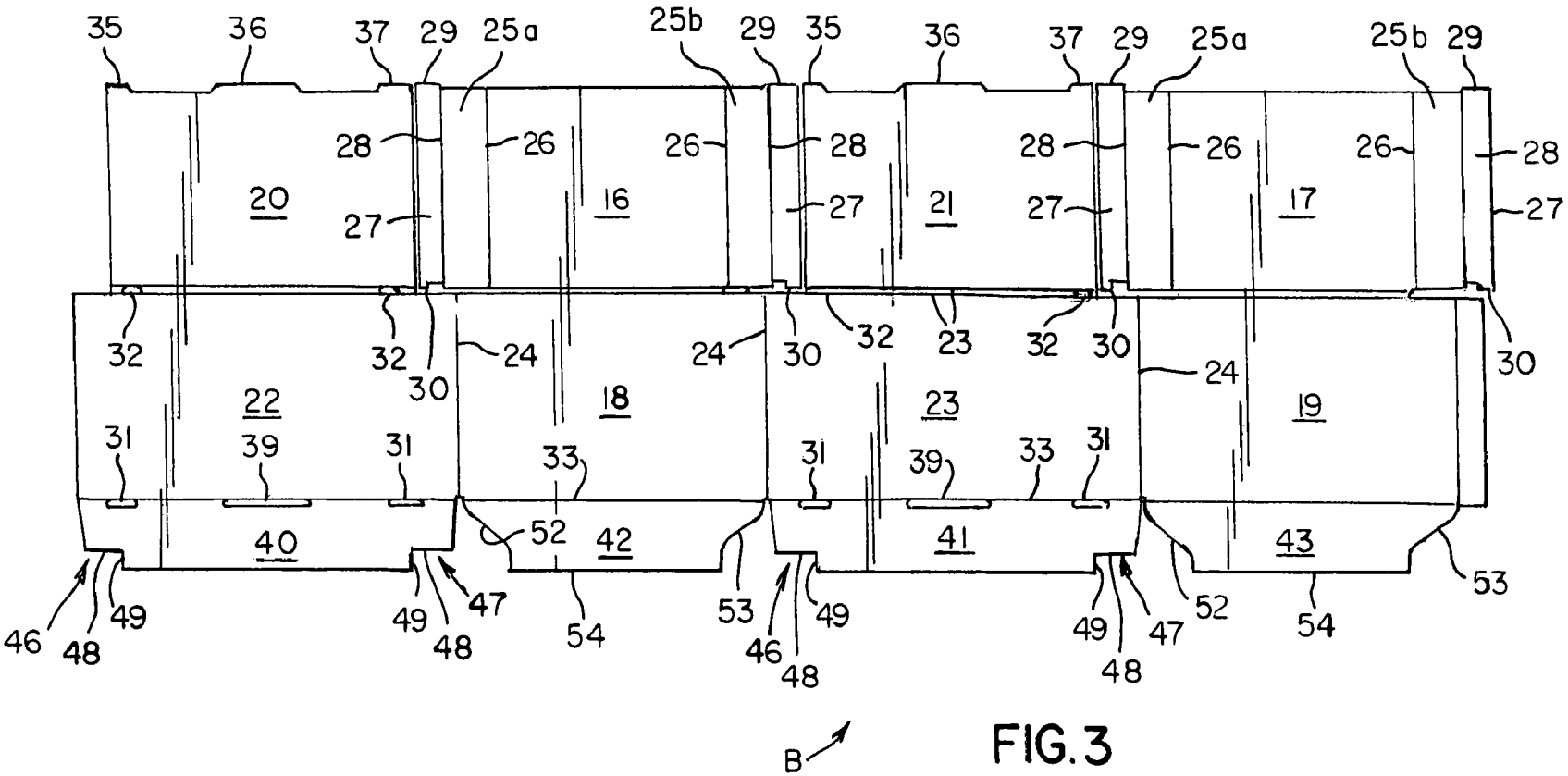
FIG. 3 is a plan view of a blank for making the container of FIG. 1.

The container 10 comprises opposite end walls 11, 12, opposite side walls 13, 14, and a narrow peripheral bottom wall 15 defining a large central opening, and is made from a single unitary blank of corrugated paperboard, indicated generally at B in FIG. 3. As described more fully hereinafter, each side wall and each end wall of the container comprises both an outer wall panel and an inner wall panel, forming a double wall construction that provides greater strength and resists outward bulging of the walls due to the weight and pressure of material in the container. Further, as described more fully hereinafter, the container of the invention is designed so that it can be quickly and easily folded into operative position without requiring the use of separate fasteners or adhesive other than to assemble the blank into its folded flat condition shown in FIG. 4.

The end walls 11 and 12 comprise inner wall panels 16 and 17, respectively, forming a first pair of opposite inner wall panels, and outer wall panels 18 and 19, respectively, forming a first pair of opposite outer wall panels. Similarly, the side walls 13 and 14 comprise inner wall panels 20 and 21, respectively, forming a second pair of opposite inner wall panels, and outer wall panels 22 and 23, respectively, forming a second pair of opposite outer wall panels. The inner wall panels are foldably connected to the outer wall panels in each wall along a pair of closely spaced fold lines 24 at the top edge of the respective wall.

Extension panels 25*a* and 25*b* are foldably joined along fold lines 26 to the opposite side edges of the first pair of inner wall panels 16 and 17, and form diagonal corner panels extending across the interior corners of the container. An assembly panel 27 is foldably joined along a fold line 28 to the outer side edge of each extension panel, and these assembly panels are captured between adjacent pairs of the second inner and outer wall panels 20, 22 and 21, 23, respectively. Additionally, locking tabs 29 and 30 project from the ends of the assembly panels, and these locking tabs are engaged in openings or slots 31 and 32 formed, respectively, in the fold 33 joining the outer wall panels 22 and 23 to the bottom 15, and in the fold 23 joining the outer wall panels to the inner wall panels 20 and 21.

The second pair of inner wall panels 20 and 21 have spaced locking tabs 35, 36 and 37 along their free lower edge, and these tabs engage in the slots 31 and 32 and in a longer slot 39 spaced between the slots 31 and 32, to hold the second pair of inner wall panels in their operative inwardly folded positions.

Bottom-forming flaps 40, 41, 42 and 43 are foldably joined along fold lines 33 to the bottom edge of respective outer wall panels 18, 19 and 22, 23. The bottom forming flaps are relatively narrow and do not close the bottom of the container, but form the peripheral annular bottom wall 15 around the interior bottom of the container, with a first pair 40 and 41 of the flaps disposed in spaced apart relationship on opposed sides of the bottom, and a second pair 42 and 43 of the flaps disposed orthogonally to the first pair.

The outer corners of the flaps 40 and 41 of the first pair are cut away, forming notches 46 and 47 in the outer corners, whereby the notches in one flap are in spaced, confronting relationship to the notches in an opposed flap. Each notch is formed by a first cut 48 extending inwardly from a side edge of the respective flap and angled slightly rearwardly toward the associated wall panel, and a second cut 49 extending from the inner end of the first cut outwardly through the free outer edge of the flap in generally perpendicular relationship to the fold 33 that joins the flap to its associated wall panel.

The flaps 42 and 43 of the second pair of bottom flaps have inwardly angled side edges 52 and 53 terminating in a reduced width locking tongue 54 on the outer free edges thereof. The locking tongue is engaged at its opposite side edges in the confronting notches 46, 46 and 47, 47 in the side edges of opposed flaps of the first pair, with the tongue lying against an interior surface of the flaps of the first pair, and the angled side edges lying against an exterior surface.

The blank B has an elongate rectangular shape and comprises first, second, third and fourth outer wall-forming panels 22, 18, 23 and 19 foldably joined together in that sequence along fold lines 55 at adjacent end edges, and forming the first and second pairs of opposed outer wall panels in an erected container, as described above. First, second, third and fourth inner wall-forming panels 20 16, 21 and 17 are each foldably joined along fold line 23 to a first side edge of a respective one of the four outer wall-forming panels. The inner wall-forming panels are separate from one another and in an erected container form the first and second pairs of opposed inner wall-forming panels associated, respectively, with the first and second pairs of outer wall-forming panels.

Extension panels 25*a* and 25*b* are foldably joined along fold lines 26 to each of the opposite side edges of the inner wall-forming panels 16 and 17 of said first pair, and form diagonal corner panels extending across the interior corners of an erected container. An assembly panel 27 is foldably joined along fold lines 28 to the outer side edge of each extension panel, and in a container erected from the blank these assembly panels are captured between adjacent inner and outer wall panels of the second pair.

Bottom-forming flaps 40, 42, 41 and 43 are foldably joined, in that sequence, along fold line 33 to respective outer wall-forming panels 22, 18, 23 and 19 along a second side edge opposite the first edge.

The outer corners of the first pair of flaps 40 and 41 are cut away, forming notches 46 and 47 in the corners. Each notch is formed by a first cut 48 extending inwardly from a side edge of the respective flap and angled slightly rearwardly toward the associated wall panel, and a second cut 49 extending from the inner end of the first cut outwardly through the free outer edge of the flap in generally perpendicular relationship to the fold 33 that joins the flap to its associated wall panel.

The flaps 42 and 43 of the second pair of bottom-forming flaps have inwardly angled side edges 52 and 53 terminating in a reduced width locking tongue 54 on the outer free edges thereof. When a container is erected from the blank, the locking tongue is engaged at its opposite side edges in the confronting notches 46, 46 and 47, 47 in the side edges of opposed flaps of the first pair, with the tongue lying against an interior surface of the flaps of the first pair, and the angled side edges lying against an exterior surface.

In an alternate embodiment indicated generally at 10' in FIGS. 15-21, a generally U-shaped cut 60 is made in each of the inner wall panels 20' and 21' of said second pair, forming a reinforcing panel 61 that is foldably connected along one edge 62 to the respective inner wall-forming panel. The U-shaped cut comprises a first cut 60A extending across a major portion of the width of said inner wall panel parallel to and spaced from said bottom edge thereof and second and third cuts 60B and 60C extending from opposite ends of said first cut in generally parallel spaced relation to opposite side edges of said inner wall panel and terminating at opposite ends of a second fold 62 extending across a major portion of the width of said inner wall panel in generally parallel spaced relation to said inner wall panel top edge and perpendicular to said end walls. The reinforcing panel is folded up and between the associated inner and outer panels, extending at its free edge 63 to the first fold 23 joining the inner and outer wall panels, providing reinforcement at the upper edge of the wall of the container to further strengthen the container against sidewall bulge. Locking tabs 64 and 65 on the outer ends of the free edge of the reinforcing panels engage in the openings 32 to help hold the container in erected condition.

The blank B' for making the alternate embodiment is identical in all respects to the blank B, except for the cut 60 and reinforcing panel 61 and associated components as described immediately above.

Figure 4:
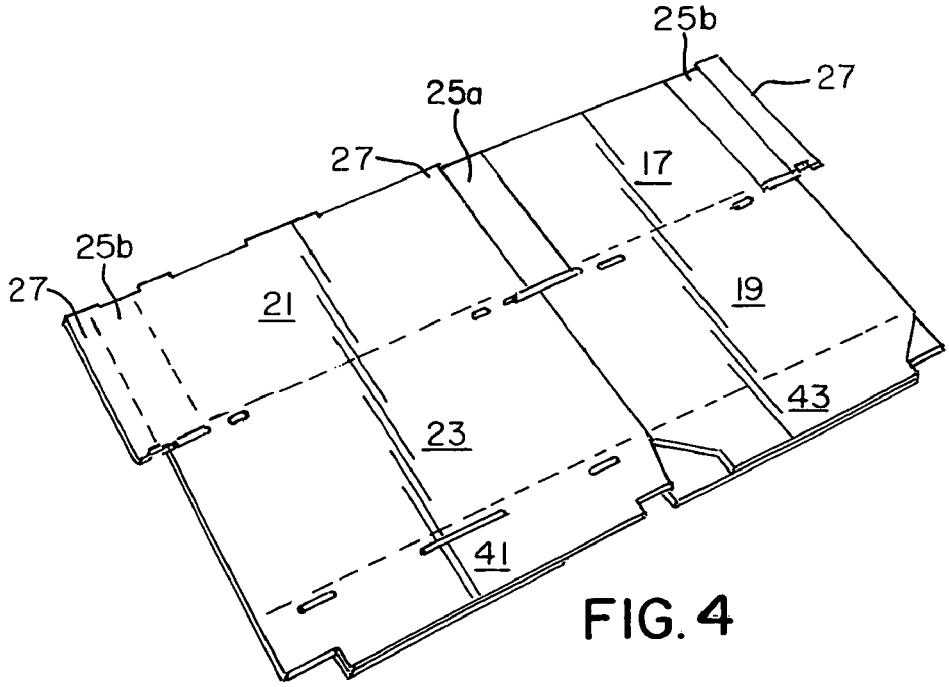
FIG. 4 is a top perspective view of a container made from the blank of FIG. 3, with the blank shown in its partially assembled, flattened condition for shipment to a point of use.
Figure 5:
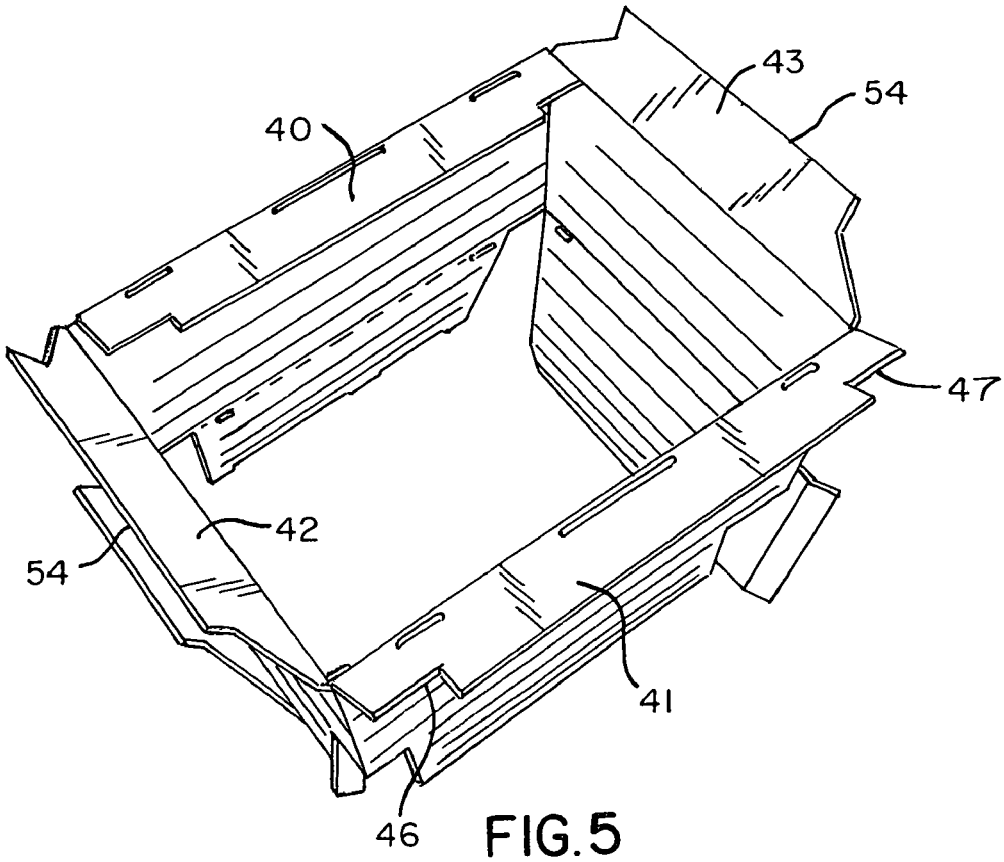
FIG. 5 is a bottom perspective view of the container of FIG. 4, shown expanded into an open tubular configuration and inverted so that the bottom is facing up.
Figure 6:
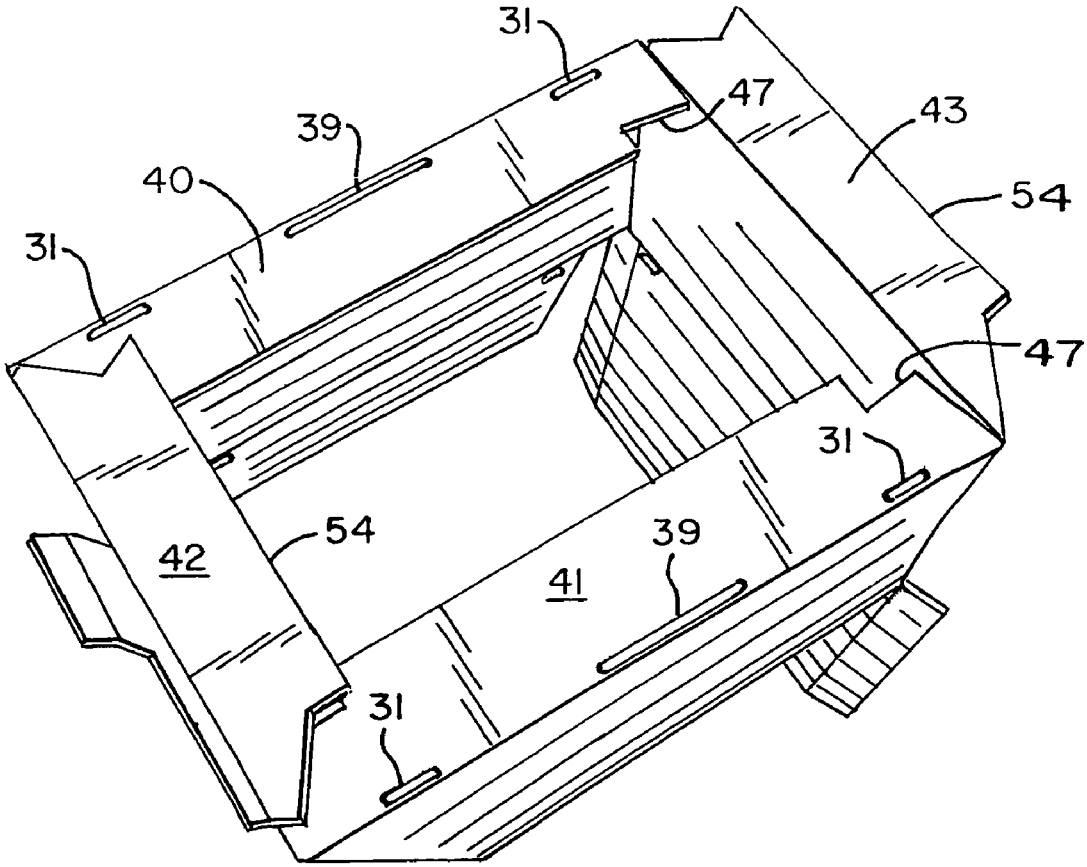
FIG. 6 is a bottom perspective view similar to FIG. 5, showing the bottom-forming flaps partially folded into operative relationship.
Figure 7:
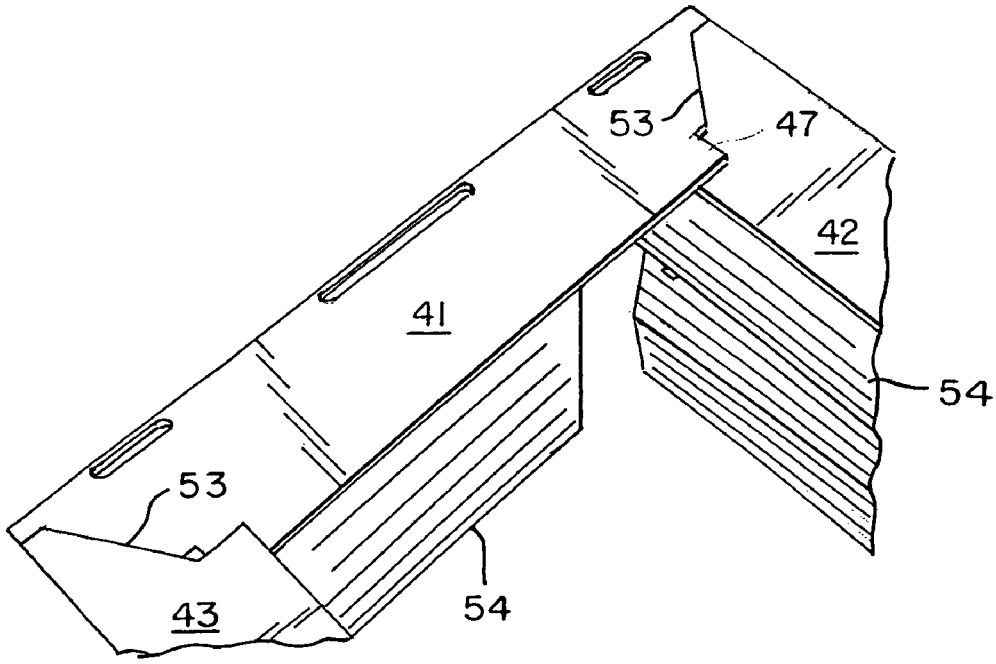
FIG. 7 is a fragmentary, slightly enlarged bottom perspective view of the container, showing the bottom-forming flaps in a further folded position, with the flaps in the upper right-hand corner of the drawing fully engaged, and the flaps in the lower left-hand corner in position just prior to the locking tongue being pushed past the adjacent flaps for engagement of the locking tongue in confronting notches of the opposed adjacent flaps.
Figure 8:
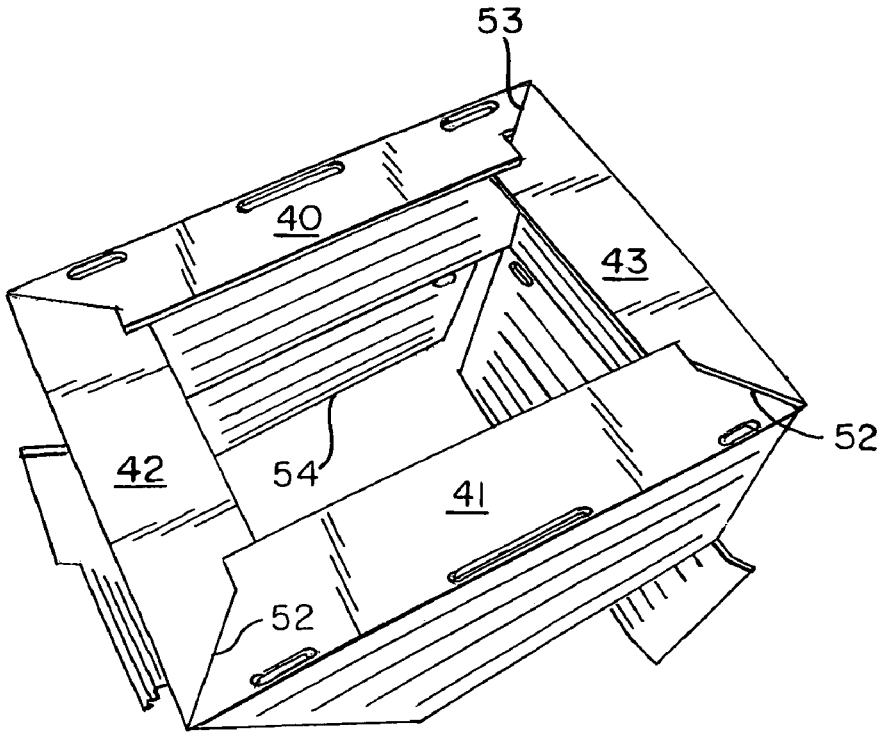
FIG. 8 is a bottom perspective view of the container, showing the bottom-forming flaps in fully assembled relationship.

To set up the container from the flattened condition shown in FIG. 4, the container is opened up into a tubular configuration and placed upside down as shown in FIG. 5. The bottom-forming panels 40 and 41 along opposite sides are first folded inwardly as shown in FIGS. 5 and 6, and the bottom-forming panels 42 and 43 are then folded inwardly over the adjacent ends of the panels 40 and 41 and pressed downwardly to force the tongues 54 past the panels 40 and 41, with opposite side edges of the tongues engaged in the notches 46 and 47 in the opposite side edges of the panels 40 and 41. Pressure is then released on the panels 42 and 43, permitting them to spring back up into the locked position shown in FIG. 8.

Figure 9:
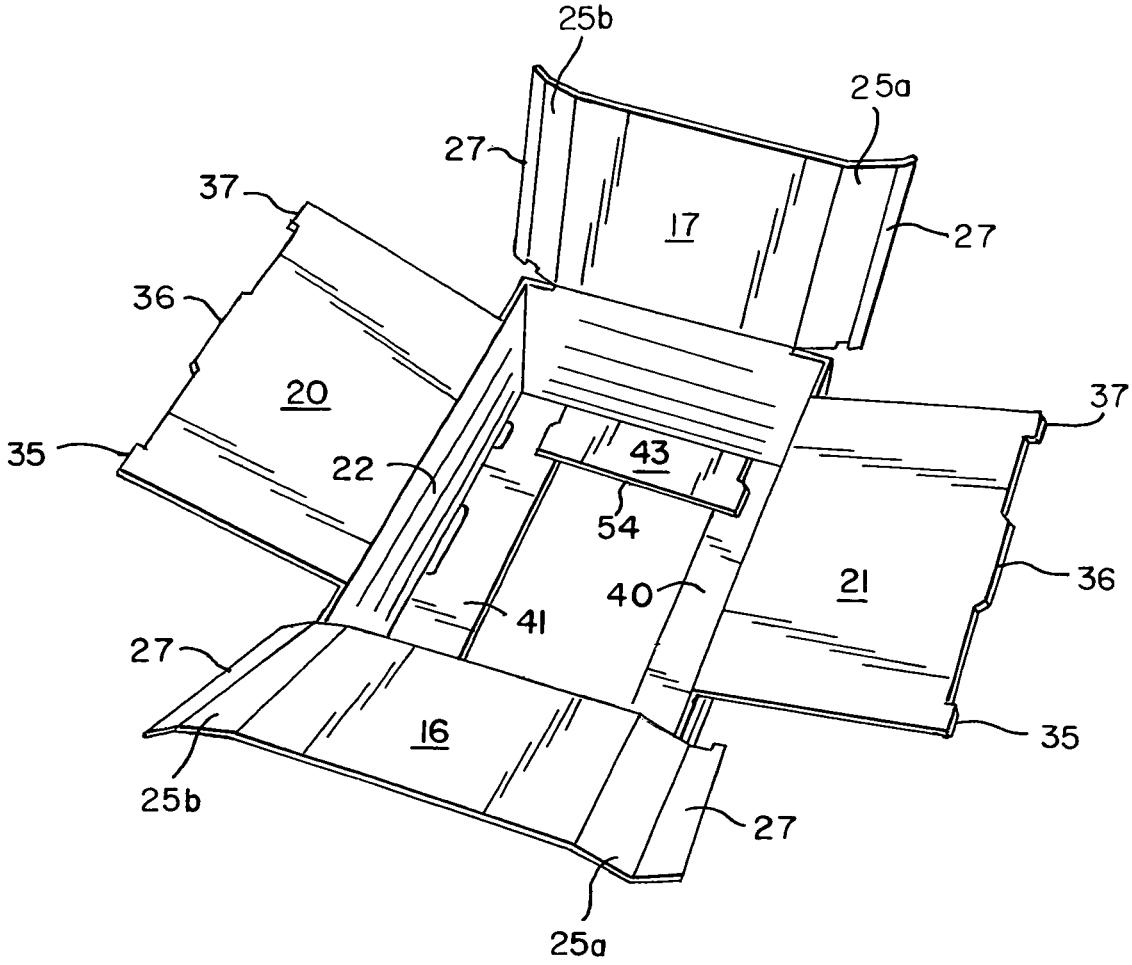
FIG. 9 is a top perspective view of the container of FIG. 1, shown in an upright position with the bottom-forming flaps interlocked with one another and the inner wall-forming panels in an unfolded position.
Figure 10:
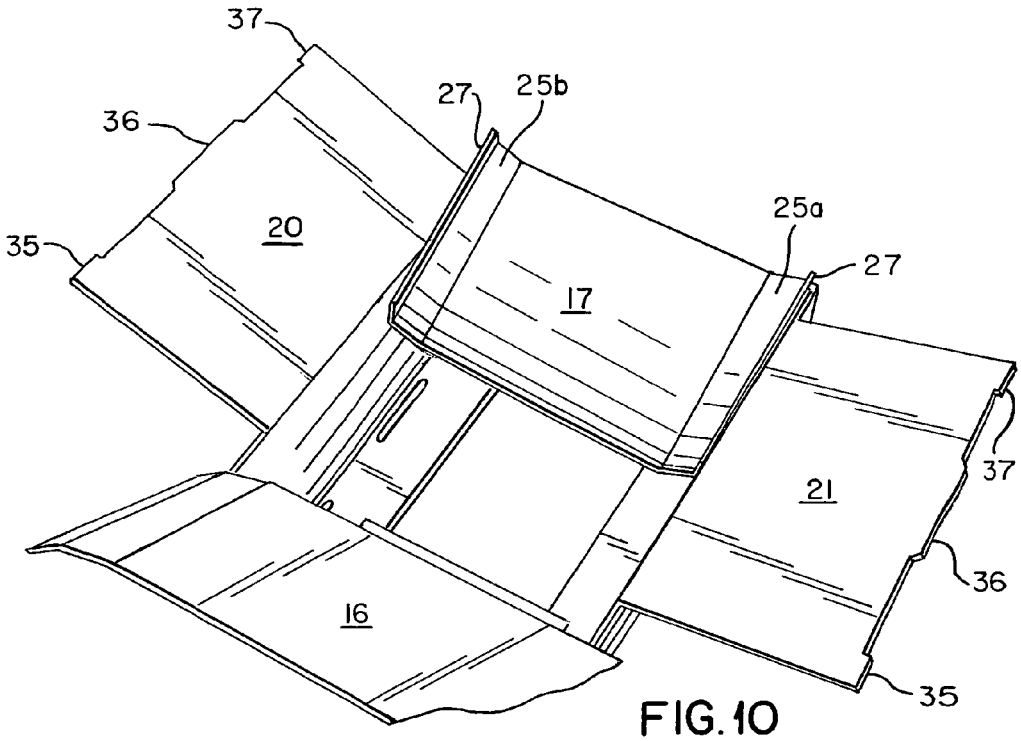
FIG. 10 is a top perspective view similar to FIG. 9, with one of the panels of the first pair partially folded into operative position, and showing how the extension panels deflect against adjacent outer wall-forming panels.
Figure 11:
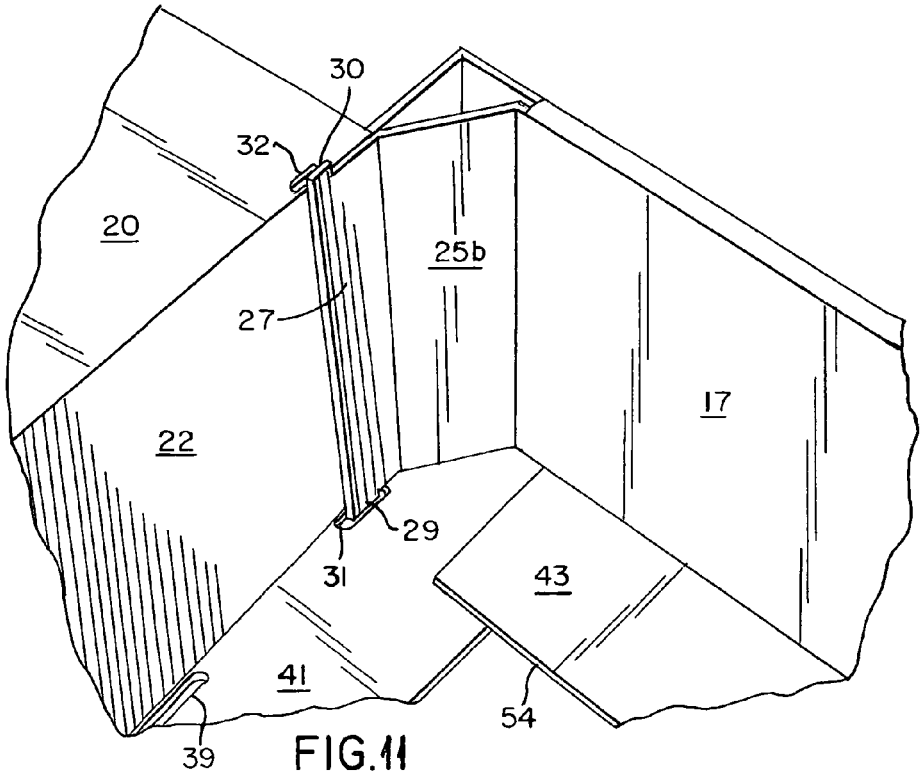
FIG. 11 is an enlarged, fragmentary, top perspective view showing said one panel of the first pair in fully folded operative position, showing how the extension panel forms an interior diagonal corner panel, and showing the locking tabs at the top and bottom ends of the assembly panel, with the locking tab at the bottom end engaged in a slot at the juncture of a bottom-forming panel and an associated outer wall-forming panel.
Figure 12:
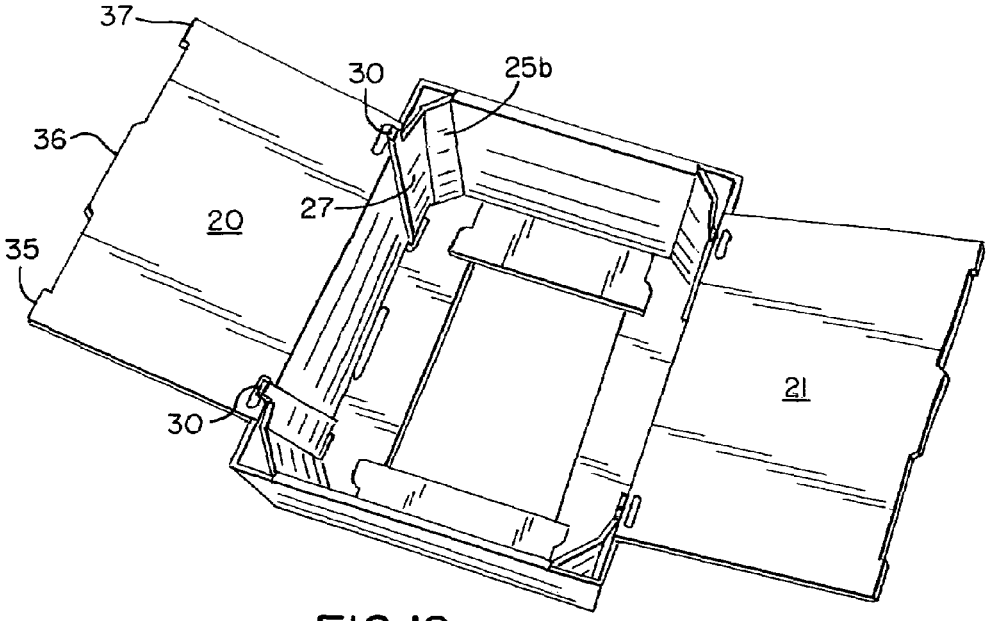
FIG. 12 is a top perspective view of the container of FIG. 10, with both panels of the first pair in fully folded operative position.
Figure 13:
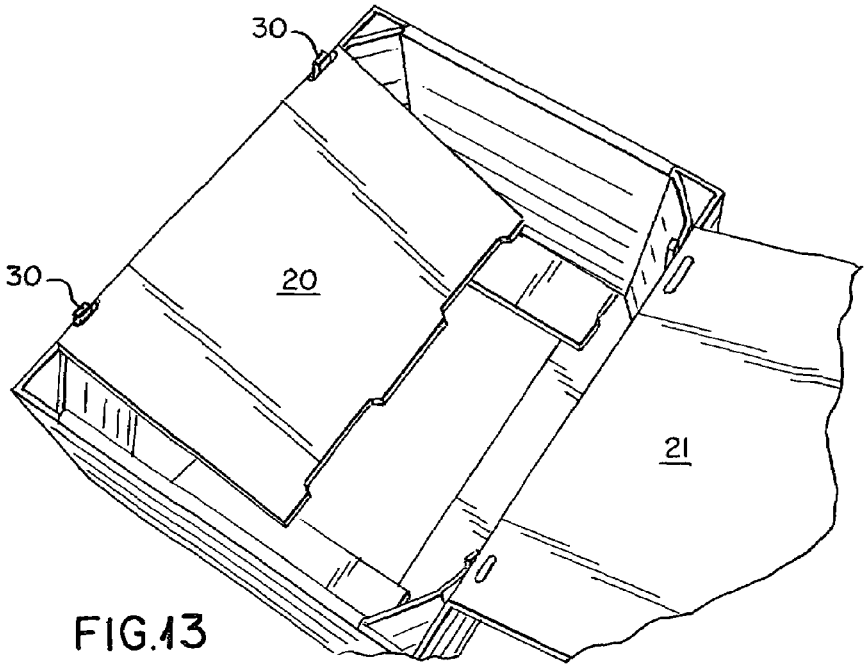
FIG. 13 is a top perspective view of the container of FIG. 12, with one of the inner wall-forming panels of the second pair partially folded into operative position, and showing how, when this panel is folded into operative position, the locking tab on the top end of the assembly panel engages in the opening at the juncture of the associated inner and outer wall-forming panels.
Figure 14:
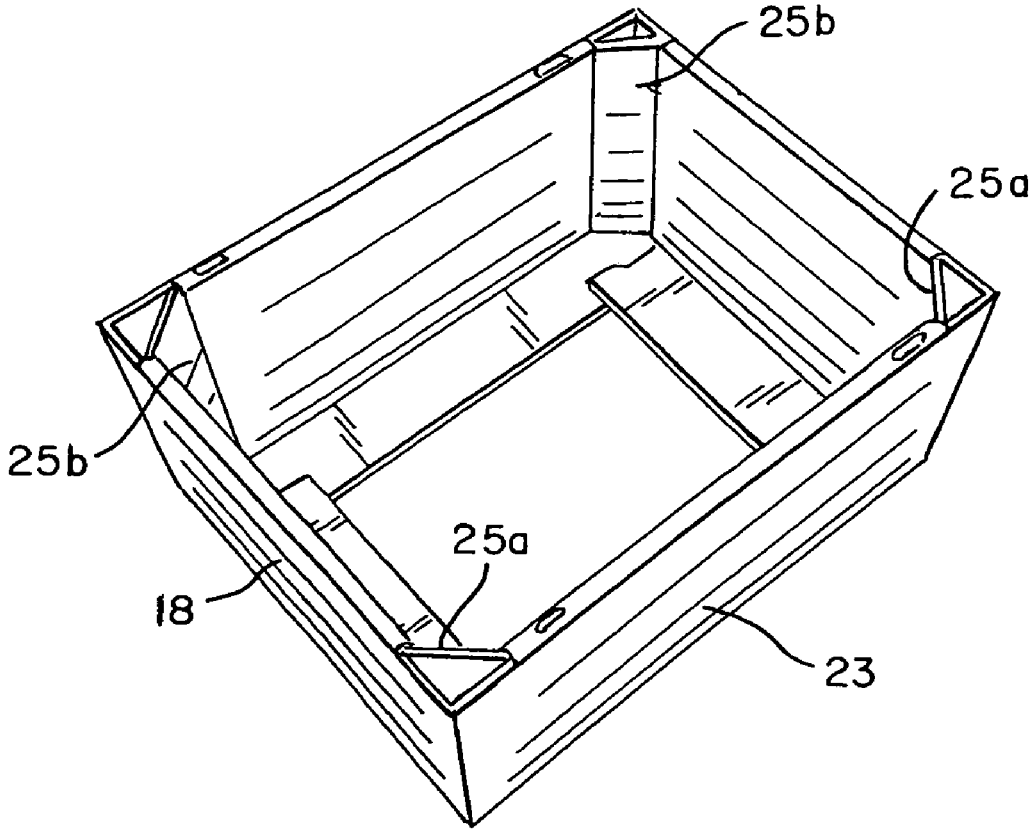
FIG. 14 is a top perspective view of a fully assembled container according to the first embodiment.
Figure 15:
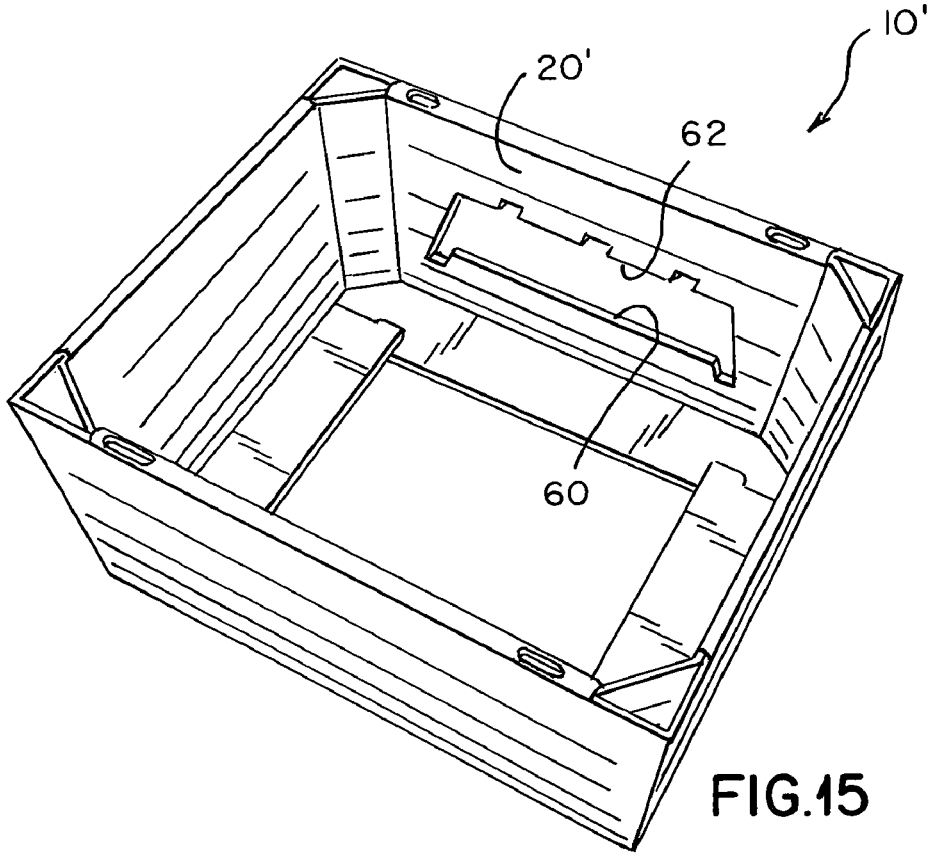
FIG. 15 is a top perspective view of a fully assembled container according to a second embodiment in which the structure is identical to the first embodiment except for a reinforcing panel in a pair of opposed inner wall-forming panels.
Figure 16:
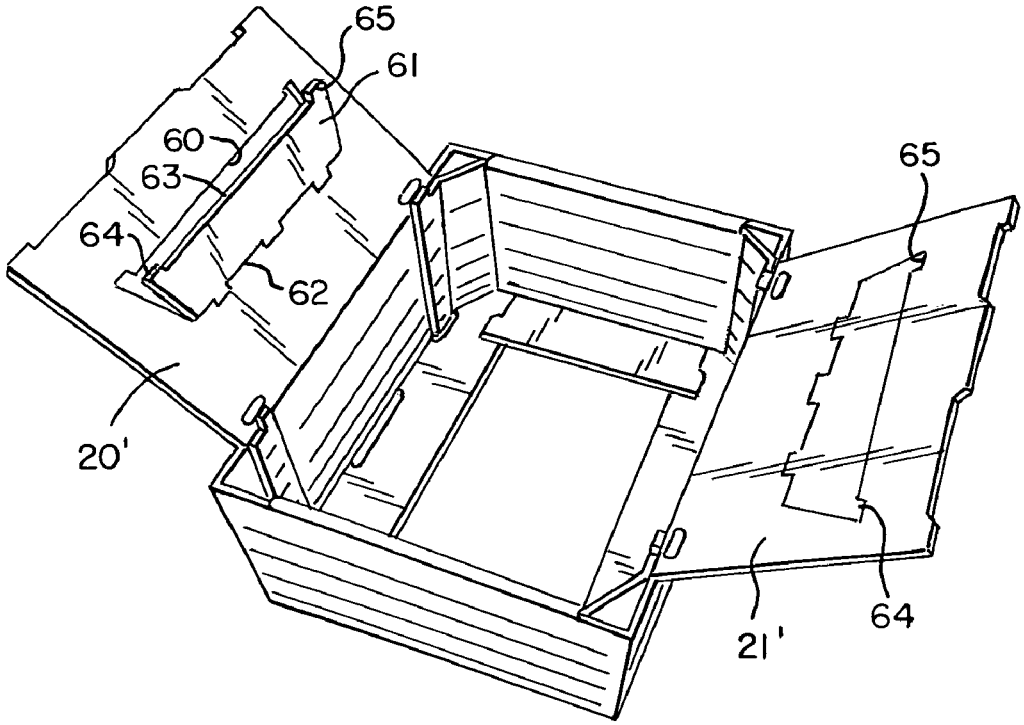
FIG. 16 is a top perspective view of the container of FIG. 15, showing the two inner wall forming panels that contain the reinforcing panel unfolded, with one of the reinforcing panels partially folded into operative position.
Figure 17:
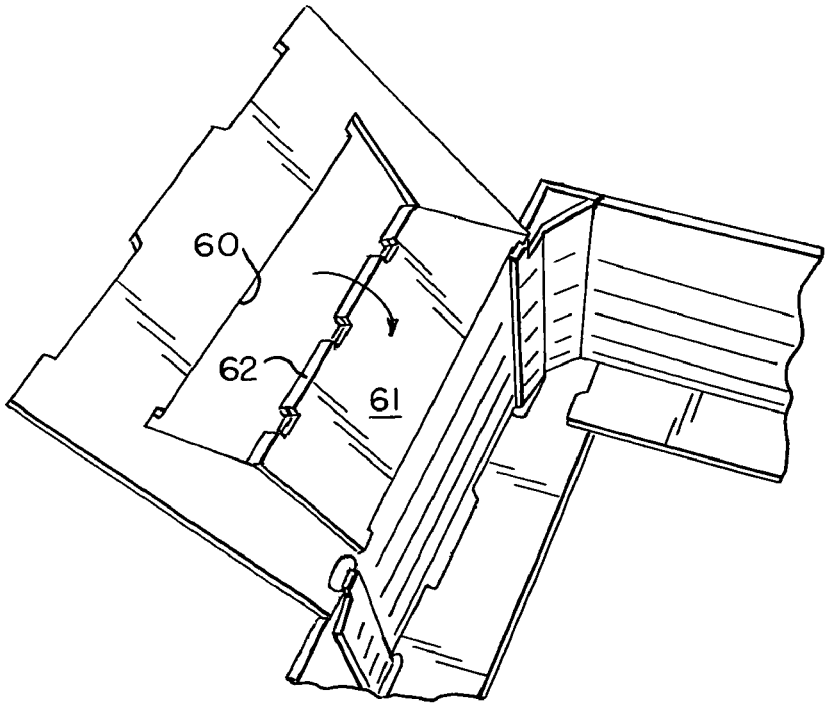
FIG. 17 is an enlarged, fragmentary, top perspective view of the container of FIG. 16, showing one of the reinforcing panels folded into its operative position relative to its associated inner wall-forming panel preparatory to the inner wall-forming panel being folded into operative position.
Figure 18:
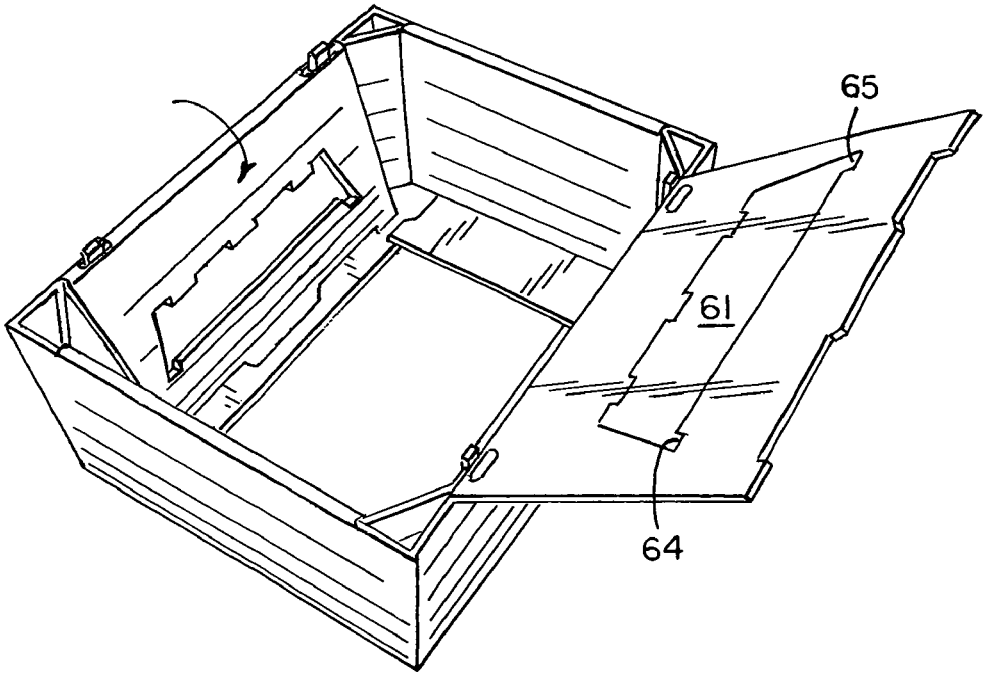
FIG. 18 is a top perspective view showing the inner wall-forming panel being folded into its operative position.
Figure 19:
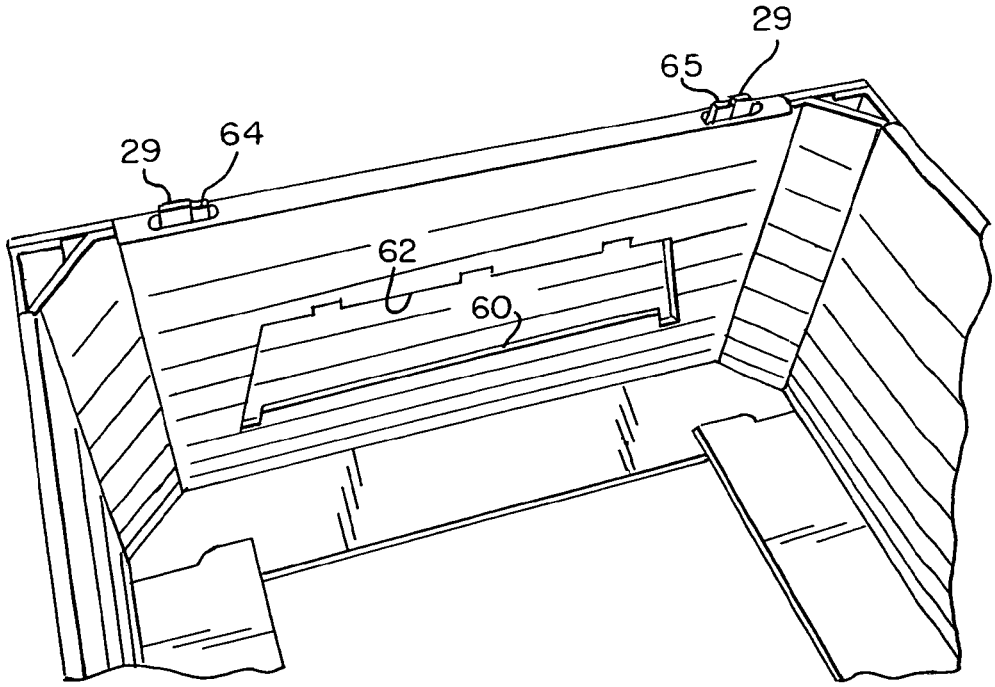
FIG. 19 is an enlarged, fragmentary, top perspective view of the container of FIG. 18, showing the inner wall-forming panel and its associated reinforcing panel in fully folded operative position.
Figure 20:
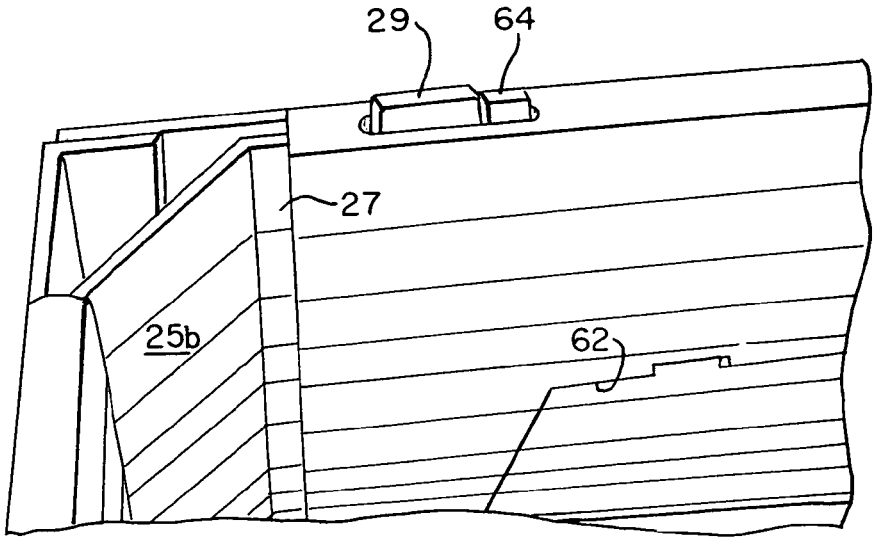
FIG. 20 is a further enlarged, fragmentary, top perspective view of the container of FIG. 19, showing details of the interrelationship of the locking tabs and panels, and also showing the glue flap that is used to connect the opposite ends of the blank when forming the flattened, partially assembled container as shown in FIG. 4.
Figure 21:
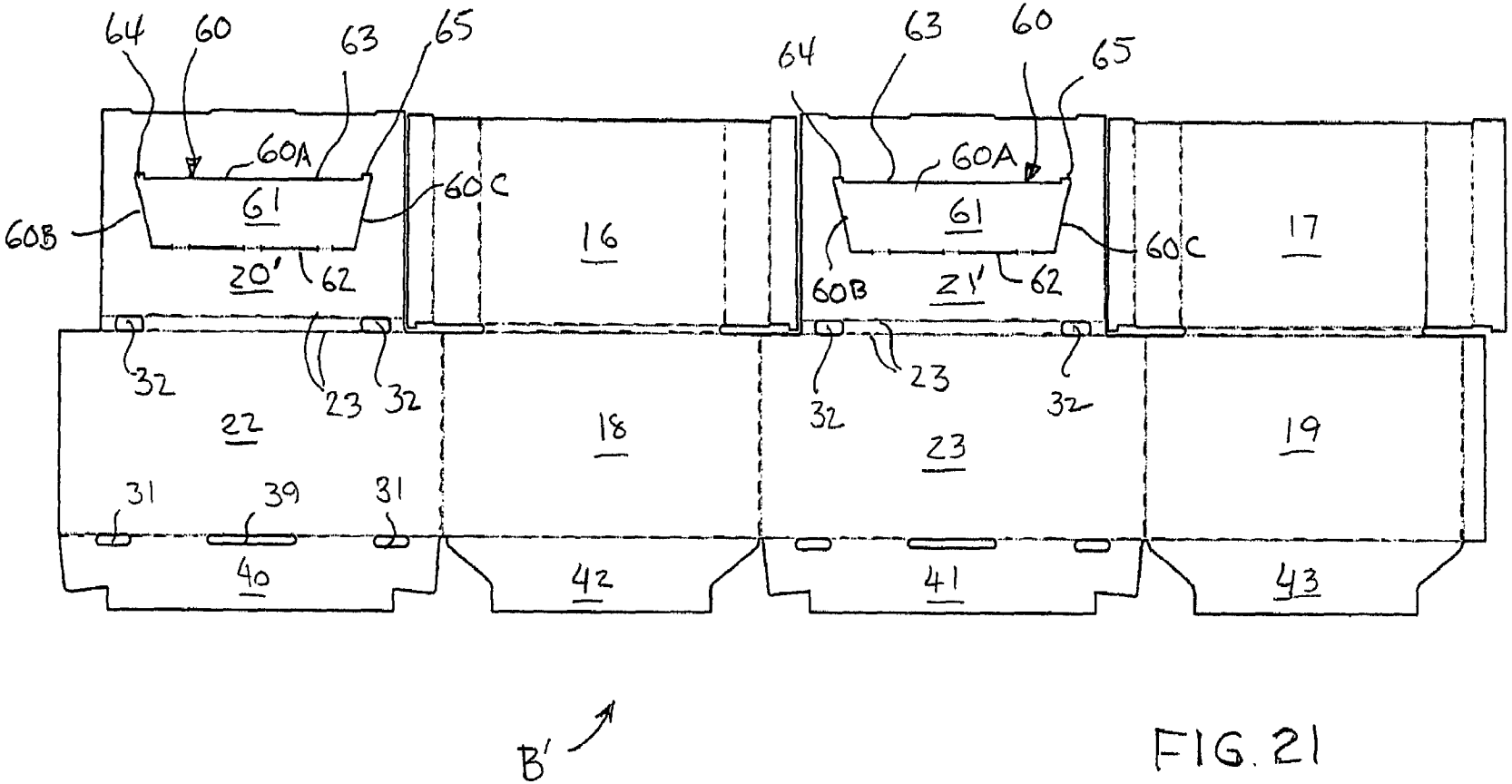
FIG. 21 is a plan view of a blank for making the container of FIGS. 15-20.

The container is then turned right side up, as shown in FIG. 9. Panels 16 and 17 are first folded inwardly and downwardly into the container until the panels 16 and 17 lie against the inside surface of panels 18 and 19 and the locking tabs 29 on the bottom ends of assembly panels 27 are engaged in slots 31, as shown in FIGS. 10 and 11. Panels 20 and 21 are then folded inwardly and downwardly into the container until the panels lie against the inside surface of panels 22 and 23 and the locking tabs 35, 36 and 37 are engaged in the slots 31 and 39. In this position, the opposite side edges of the panels 20 and 21 overlie the assembly panels 27, capturing the panels 27 between the inner and outer panels 20, 22 and 21, 23, with the tabs 30 on the upper ends of the panels 27 engaged in the slots 32.

Identical steps are followed with the second embodiment shown in FIGS. 15-21, except that prior to folding the panels 20' and 21' into the container, the reinforcing panels 61 are first folded about edge 62 to position the free edge 63 of the reinforcing panel adjacent the juncture of panels 20' and 22. Then, when the panels 20' and 21' are folded into the container, the tabs 64 and 65 on the outer end edges thereof engage in the slots 32 and the reinforcing panels are captured between the inner and outer panels 20', 22 and 21', 23.

In a specific example of a container according to the invention, the container is about four feet long, three feet wide and two feet high, and the diagonal corner panels have a width of about six inches. In the second embodiment described herein, the reinforcing panel has a height or width from its folding connection with the associated wall panel to the free edge of the reinforcing panel of about eight inches, and the folding connection is spaced slightly more than eight inches from the fold connecting that inner wall panel to its associated outer wall panel. However, it is to be understood that the container can have various dimensions to suit a particular need, and the particular dimensions and/or scale as described are not intended to be limiting.

Although particular embodiments of the invention are illustrated and described in detail herein, it is to be understood that various changes and modifications may be made to the invention without departing from the spirit and intent of the invention as defined by the scope of the appended claims.

What is claimed is:

1. A container for shipping products, comprising:

opposed side walls and opposed end walls, said side and end walls each comprising an outer wall panel and an inner wall panel having top and bottom edges and foldably joined together along a first fold at said top edges thereof, said inner wall panel being substantially coextensive in height and width with an associated said outer wall panel; and a reinforcing panel in an upper portion of at least one of said side walls, said reinforcing panel being folded from the inner wall panel of said at least one side wall and formed by a generally U-shaped cut comprising a first cut extending across a major portion of the width of said inner wall panel parallel to and spaced from said bottom edge thereof and second and third cuts extending from opposite ends of said first cut in generally parallel spaced relation to opposite side edges of said inner wall panel and terminating at opposite ends of a second fold extending across a major portion of the width of said inner wall panel in generally parallel spaced relation to said inner wall panel top edge and perpendicular to said end walls, said reinforcing panel having a free edge opposite said fold and being folded upwardly about the fold and lying between the inner wall panel and an associated outer wall panel with the free edge thereof extending to adjacent a top edge of the outer wall panel to reinforce the said wall, said outer wall panel extending over and covering that area of said inner wall panel from which said reinforcing panel is folded, whereby no through opening is formed in said at least one said side wall by folding said reinforcing panel into operative position between said inner and outer wall panels.

2. A container as claimed in claim 1, wherein:

the outer wall panels in the side walls are disposed orthogonally to the outer wall panels in the end walls to define a rectangular or square outer container configuration; and an extension panel is on opposite side edges of a first pair of said inner wall panels that are disposed in opposed relationship to one another, said extension panels extending diagonally across interior corners of the container to define an octagonal inner container configuration.

3. A container as claimed in claim 2, wherein:

a bottom-forming flap is foldably joined to the bottom edge of each of said outer wall panels, said bottom-forming flaps having interengaged locking means on adjacent edges thereof to hold the bottom-forming flaps in operative position.

4. A container as claimed in claim 3, wherein:

each said inner wall panel is folded downwardly into the container and against an inner surface of an associated outer wall panel.

5. A container as claimed in claim 4, wherein:

an assembly panel is on an outer edge of each said extension panel, said assembly panels lying against an inner surface of an adjacent said outer wall panel; and said assembly panels are captured between the adjacent said outer wall panel and a respective one of a second pair of said inner wall panels, said second pair being disposed orthogonally to said first pair.

6. A container as claimed in claim 5, wherein:

said inner wall panels have a height substantially coextensive with the height of said outer wall panels, and a width substantially coextensive with the distance between adjacent edges of said diagonal corner panels.

7. A container as claimed in claim 6, wherein:

locking tabs are on a bottom edge of the inner wall panels of said second pair, said locking tabs being engaged in slots at the juncture between the outer wall panels and the bottom-forming panels.

8. A container as claimed in claim 7, wherein:

said assembly panels have an upper end and a lower end and a height substantially coextensive with the height of the outer wall panels; and a locking tab is on at least one of the upper and lower ends, said locking tab engaged in a slot to hold the assembly panel in position.

9. A container as claimed in claim 8, wherein:

a locking tab is on each of the upper and lower ends of the assembly panels, and said locking tabs are engaged in slots at the top and bottom edges, respectively, of the outer wall panels.

10. A container as claimed in claim 1, wherein:

at least one slot is formed in said first fold joining said top edges of said inner and outer wall panels; and at least one locking tab is on the free edge of the reinforcing panel, said at least one locking tab on the free edge of the reinforcing panel being engaged in said at least one slot in said first fold.

11. A container as claimed in claim 10, wherein:

said second fold is spaced downwardly from the top edge of said inner wall panel a distance approximately one-third the height of the inner wall panel; and said first cut is spaced upwardly from said bottom edge of said inner wall panel approximately one-third the height of the inner wall panel.

12. A one-piece unitary blank of corrugated paperboard for making a shipping container, said blank having an elongate rectangular shape, and comprising:

first, second, third and fourth outer wall-forming panels foldably joined together along adjacent end edges, and forming first and second pairs of opposed outer wall panels in a container erected from said blank;

first, second, third and fourth inner wall-forming panels each foldably joined to a first side edge of a respective one of the four outer wall-forming panels, said inner wall-forming panels being separate from one another and in a container erected from said blank forming first and second pairs of opposed inner wall-forming panels associated, respectively, with the first and second pairs of outer wall-forming panels; and a quick-lock bottom comprising a bottom-forming flap foldably joined to each of the outer wall-forming panels along an edge thereof opposite the edge to which the inner wall-forming panels are joined, the flaps of a first pair of the bottom-forming flaps being disposed in spaced, parallel, opposed relationship to one another in a container erected from the blank, and the flaps of a second pair of said bottom-forming flaps being disposed in spaced, parallel, opposed relationship to one another and extending perpendicular to and between the flaps of the first pair in a container erected from the blank, wherein the outer corners of the flaps of the first pair are cut away, forming notches in the outer corners, with each notch formed by a first cut extending inwardly from a side edge of the respective flap and a second cut extending from an inner end of the first cut outwardly through the free outer edge of the flap, said first and second cuts extending at substantially a right angle to one another, the flaps of said second pair of said bottom-forming flaps each having inwardly angled side edges terminating in a cut extending perpendicularly through the outer free edge thereof, defining a reduced width locking tongue on the outer free edge of each flap of said second pair of bottom-forming flaps, so that in a container erected from the blank the locking tongue is engaged at its opposite side edges in the confronting notches in the side edges of opposed flaps of the first pair, with the tongue lying against an interior surface of the flaps of the first pair, and the angled side edges lying against an exterior surface.

13. A one-piece unitary blank as claimed in claim 12, wherein:

an extension panel is foldably joined to each of the opposite side edges of the inner wall-forming panels of said first pair of said inner wall-forming panels, said extension panels forming diagonal corner panels extending across interior corners of a container erected from said blank.

14. A one-piece unitary blank of corrugated paperboard for making a shipping container, said blank having an elongate rectangular shape, and comprising:

first, second, third and fourth outer wall-forming panels foldably joined together along adjacent end edges, and forming first and second pairs of opposed outer wall panels in a container erected from said blank;

first, second, third and fourth inner wall-forming panels having opposite side edges and each foldably joined along a first fold to a first side edge of a respective one of the four outer wall-forming panels, said inner wall-forming panels being separate from one another along adjacent side edges and in a container erected from said blank forming first and second pairs of opposed inner wall-forming panels associated, respectively, with the first and second pairs of outer wall-forming panels; and a reinforcing panel in each said inner wall-forming panel of one of said pairs of opposed inner wall-forming panels, each said reinforcing panel being defined by a generally U-shaped cut extending across a major portion of the width of said inner wall-forming panel and terminating at its opposite ends at the opposite ends of a second fold extending across a major portion of the width of said inner wall-forming panel in parallel spaced relation to said first fold, said reinforcing panel having a free edge and an opposite edge that is connected to the associated inner wall-forming panel along said second fold, said reinforcing panel being foldable about said second fold into a position to lie between the inner wall-forming panel and an associated outer wall-forming panel, with the free edge of the reinforcing panel extending to adjacent an upper edge of a wall of said container to thereby reinforce the wall in a container erected from said blank, said associated outer wall-forming panel extending over and covering the area of said inner wall-forming panel vacated by said reinforcing panel in a container erected from said blank.

15. A one-piece shipping container made from a single unitary blank of corrugated paperboard assembled in a flattened condition by a manufacturer for shipment to a point of use, where the container can be quickly and easily set up into a fully erected condition ready for use without requiring the use of glue or other fasteners, comprising:

opposed side walls, opposed end walls, and a bottom, said side and end walls each comprising an inner wall panel and an outer wall panel defining double thickness walls;

the outer wall panels in the side walls being disposed orthogonally to the outer wall panels in the end walls to define a rectangular or square outer container configuration;

an extension panel on opposite side edges of a first pair of opposed said inner wall panels, said extension panels extending diagonally across interior corners of the container to define diagonal interior corner panels and form an octagonal interior container configuration;

said outer wall panels and said inner wall panels each having top and bottom edges;

at least one locking tab on the bottom edge of said inner wall panels of said first pair, said at least one locking tab engaged in a slot at the juncture between the outer wall panels and the bottom-forming panels to hold the inner wall panels in operative position;

said bottom comprising a bottom-forming flap foldably joined to the bottom edge of each said outer wall panel, said bottom-forming flaps having interengaged locking means on adjacent outer corners thereof to hold the bottom-forming flaps in operative position, said locking means comprising:

cut away outer corners on a first pair of spaced apart, parallel, opposed said bottom-forming flaps, forming confronting notches in the outer corners of said opposed flaps of the first pair, with each notch formed by a first cut extending inwardly from a side edge of the respective flap and a second cut extending from an inner end of the first cut perpendicularly outwardly through the free outer edge of the flap, said first and second cuts extending at substantially a right angle to each other; and inwardly angled side edges of a second pair of said bottom-forming flaps that extend perpendicular to and between the flaps of the first pair, the inwardly angled side edges of each flap of the second pair terminating in a cut extending perpendicularly through the outer free edge of the flap, defining a reduced width locking tongue on the outer free edge thereof, said locking tongue engaged at opposite side edges thereof in the confronting notches in the side edges of opposed flaps of the first pair, with the tongue lying against an interior surface of the flaps of the first pair, and the angled side edges lying against an exterior surface.

16. A container as claimed in claim 15, wherein:

an assembly panel is foldably joined to an outer side edge of each said extension panel;

said assembly panels have an upper end and a lower end and a height substantially coextensive with the height of the outer wall panels; and a locking tab is on at least one of the upper and lower ends of each said assembly panel, said locking tabs engaged in respective slots to hold the assembly panels in position.

17. A container as claimed in claim 16, wherein:

a locking tab is on each of the upper and lower ends of the assembly panels, and said locking tabs are engaged in slots at the top and bottom edges, respectively, of the outer wall panels.

18. A container as claimed in claim 15, wherein:

a reinforcing panel is formed in each inner wall panel of said second pair of inner wall panels, said reinforcing panels each being formed by a cut and a fold in the associated inner wall panel, said fold extending between opposite ends of said cut and extending perpendicular to said end walls, said reinforcing panels each having a free edge and being folded upwardly between the respective inner wall panel and an associated outer wall panel and extending at its free edge to adjacent the top edge of the outer wall panel to reinforce the side wall.

19. A container as claimed in claim 15, wherein:

there are a plurality of locking tabs spaced along the bottom edge of each said inner wall panel of a second pair of said inner wall panels, said locking tabs being engaged in respective associated slots.

20. A container as claimed in claim 15, wherein:

said inner wall panels have a height substantially coextensive with the height of said outer wall panels, and a width substantially coextensive with the distance between adjacent edges of said diagonal interior corner panels.

* * * * *